US005896693A

United States Patent [19]

Ray

[11] Patent Number: 5,896,693

[45] Date of Patent: Apr. 27, 1999

[54] SPIN CAST AND FLIPPING TARGET PAD

[76] Inventor: Clyde Travis Ray, 8901 Hwy. 5 North, Alexander, Ark. 72002

[21] Appl. No.: 08/782,122

[22] Filed: Jan. 13, 1997

[51] Int. Cl.[6] ..... H63B 67/10

[52] U.S. Cl. ..... 43/4; 273/330; 273/140; 273/350

[58] Field of Search ..... 43/1, 4, 19; 273/1, 273/140, 371, 350, 330

[56] References Cited

U.S. PATENT DOCUMENTS

| | | | |
|---|---|---|---|
| 2,747,872 | 5/1956 | Harvey | 273/1 |
| 4,351,270 | 9/1982 | Sabin | 119/5 |
| 4,588,618 | 5/1986 | Wolfe | 428/7 |
| 4,976,439 | 12/1990 | Kraemer | 273/350 |
| 5,207,424 | 5/1993 | Bleam et al. | 273/140 |
| 5,639,093 | 6/1997 | Law et al. | 273/371 |

*Primary Examiner*—Joseph J. Hail, III
*Attorney, Agent, or Firm*—Jerry L. Mahurin

[57] ABSTRACT

An integral spin cast and flipping target pad comprising a base portion and an open top, generally cylindrical, target portion extending upwardly from the base. Preferably, the target cylinder is shaped like a fish head and the base defines lily pad shapes in its upper surface. The base comprises a bottom portion, a top portion and an edge portion extending between the bottom and the top defining a flotation cavity within the base. Alternatively, the base may be made of decorative wood. The target cylinder comprises a generally cylindrical wall extending upwardly from the top portion of the base. The wall can be comprised of spaced apart generally cylindrical outer and inner wall portions extending upwardly from the top portion of the base and a lip portion extending between a top of the inner wall and a top of the outer wall. Preferably, gussets extend from the target cylinder to the top of the base. These gussets are shaped like fish fins associated with the fish head shaped target cylinder. In the preferred embodiment the target pad is resilient. A game course employing the target pads is also disclosed. The target pads float in ponds with obstacles disposed between the floating target pad and a casting station. The casting stations are shaped like the bow or stern of a fishing boat.

6 Claims, 10 Drawing Sheets

SPIN CAST AND FLIPPING TARGET PAD

BACKGROUND OF THE INVENTION

The present invention broadly relates to fishing. Specifically, the present invention is a Spin Cast and Flipping Target Pad. Art pertinent to the subject matter of the present invention can be found in United States Patent Class 43, Subclasses 1 and 19 and various Subclasses of Class 273 namely Subclasses 348 and 342.

As is well know to those skilled in the art fishing rod casting is a skill employed to varying degrees by fishermen of various levels. It is common for a novice to use the casting of bait as nothing more than a means to get the bait in the water, out away from a bank, dock or boat. It has long been the practice in fly fishing to present the lure, a fly, to a fish in a natural manner. In bass fishing and other similar bait cast fishing it has proven useful to present a jig, plastic worm, spoon or other artificial lure in a natural manner in close proximity to a fish or likely fish habitat with minimal splash or other disturbance. While an overhand cast is used to propel a lure a relatively great distance an underhand or flipping action can be used to cast a lure with accuracy and relatively little splash to provide a more natural presentation of the lure. Flipping further has the advantage of allowing one to cast under obstacles, such as overhanging tree limbs or rock formations, which will normally prevent the use of an overhand cast. Since the flip results in a relatively short run in which to work a lure, it is important that the lure be accurately cast.

Casting practice has long been employed by fishermen to hone skill and coordination with a rod and reel. A casting plug, a relatively smooth, weighted bob attached to the end of the fishing line, is often used to allow casting practice out of the water, in ones backyard or the like. This casting practice can often take the form of a game or competition. As a game, casting practice is particularly attractive to children and can aid in improving not only their fishing skills but their eye-hand coordination as well.

Fishing games are, and for quite some time have been, popular diversions. Haigh U.S. Pat. No. 626,995, discloses a fishing game employing an artificial pond or trough and artificial fish with a link extending upward from their heads to capture the hook of a player. Newberger, U.S. Pat. No. 4,744,565, discloses a fish swallowing game employing a hollow fish shaped receptacle to receive small toy fish. Wakimura, U.S. Pat. No. 4,224,761, describes a toy fishing game employing upwardly disposed fish models with closeable mouths to receive a toy bait. Lowrance, U.S. Pat. No. 5,094,461, discloses a fishing game employing fishing shaped silhouettes removably mounted on a "T" shaped stake. A player can catch one of the fish silhouettes by casting a plug in such a way that the fishing line lies across the "V" shaped mouth of a silhouette.

While the aforementioned games might aid one in developing their skills as a fisherman or the interest of children in the sport of fishing, more serious targets have also been used. Hotchkiss, U.S. Pat. No. 5,368,307 discloses a waterproof closed cell foam plastic bowfishing target shaped like the body of a fish. A weight is used to hold the target a predetermined depth below the surface of the water. La Due U.S. Pat. No. 2,320,145, discloses a submersible, self propelled target fish. Kraemer, U.S. Pat. No. 4,976,439, discloses a yard casting assembly having a fish shaped outline. The assembly employs a plurality of pegs extending upwardly to capture a casting practice bob. O'Brien, U.S. Pat. No. 5,297,355, discloses a fly fishing practice device comprising a magnetic conducting plate target with visual an aural indicators. Bleam, U.S. Pat. No. 5,207,424, discloses a casting game employing a platform surrounded by a pool of water with a plurality of cylindrical open ended targets.

The prior art fails to disclose a target well adapted for practicing spin casting or flipping. The devices disclosed in the prior art either fail to give realistic feedback to the fisherman or use complicated relatively fragile and sedentary electronics to do so. Furthermore, the traditional casting plugs employed by some of these devices do not provide realistic feedback to the fisherman. In other words an artificial bait can be extremely light or relatively heavy, additionally the varied shapes can result in a wide range of casting feels. In short, a realistic shiner or minnow lure, a jig, a plastic worm, a spoon and a fly all cast very differently.

Hence, it is desirous to provide a spin cast and flipping target pad which is capable of being used on a relatively solid supporting surface such as the ground or a floor. Preferably, at least one embodiment of the target pad should also be capable of floating in water. The target pad should provide the fisherman instantaneous feedback and should be capable of being used with the actual lures employed while fishing. Preferably, the target pad should also be rugged and sturdy while also being portable for use in various locations.

SUMMARY OF THE INVENTION

My spin cast and flipping target pad can be set upon the ground, floor or other supporting surface to act as a target for a fisherman. It has a generally circular base, preferably defining raised lily pad shapes on its upper surface. An open topped, generally cylindrical lure receptacle, preferably in the shape of a fish head, such as the head of a Large Mouth Bass, extends upwardly from the base. Gussets in the shape of fish fins extend from the target cylinder to the base portion to provide support and rigidity to the target cylinder.

My target pad provides the fisherman with instantaneous feedback allowing him to know exactly in what direction he missed the target. Additionally, my target pad can be used with the actual lures employed while fishing. All surfaces of the pad both inside and out are smooth to avoid snagging the hooks of a lure used to practice casting or flipping. The preferred embodiment of the target pad is formed from injection molded plastic or rubber with the base providing sufficient buoyancy to float the pad on the surface of a body of water. A second embodiment of the invention employs an attractive, decorative, wooden base. This embodiment is particularly well suited for use in an office or home while the more rugged, weatherproof, floating target pad is well suited for outdoor use.

Therefore, a primary object of the present invention is to provide a Spin Cast and Flipping Target Pad.

An object of the present spin cast and flipping target pad is to provide a target well adapted for practicing spin casting or flipping skills.

An object of the present invention is to provide a spin cast and flipping target pad which is rugged and sturdy.

Another object of the present invention is to provide a spin cast and flipping target pad which is portable for use in various locations.

An object of the present invention is to provide a spin cast and flipping target pad which is capable of being used on a supporting surface such as the ground, a floor or the like.

Another object of the present invention is to provide a spin cast and flipping target pad which is also capable of floating in water.

A related object of the present invention is to provide a resilient spin cast and flipping target pad formed of injection molded plastic or rubber with the base providing sufficient buoyancy to float the pad upright on the surface of a body of water.

An object of the present invention is to provide a target pad which will give the user instantaneous feedback.

A related object of the present invention is to provide a target pad capable of being used with the actual lures employed while fishing.

Particularly, an object of the present invention is to provide a target pad in which both the interior and exterior surfaces are relatively smooth, other than for subtle texturing, to avoid snagging the hooks of a lure when used to practice casting or flipping.

An object of the present invention is to provide a spin cast and flipping target pad which has a base defining raised lily pad shapes in its upper surface.

An object of the present invention is to provide a spin cast and flipping target pad which has a lure receptacle in the shape of a fish head.

Particularly, an object of the present invention is to provide a spin cast and flipping target pad which has a lure receptacle in the shape of the head of a Large Mouth Bass.

An object of the present invention is to provide a spin cast and flipping target pad which has gussets in the shape of fish fins supporting the target cylinder on the base.

Alternatively, an object of the present invention is to provide a spin cast and flipping target pad which has an attractive, decorative, wooden base These and other objects and advantages of the present invention, along with features of novelty appurtenant thereto, will appear or become apparent in the course of the following descriptive sections.

BRIEF DESCRIPTION OF THE DRAWINGS

In the following drawings, which form a part of the specification and which are to be construed in conjunction therewith and in which like reference numerals have been employed throughout wherever possible to indicate like parts in the various views.

DETAILED DESCRIPTION

Figure 1:
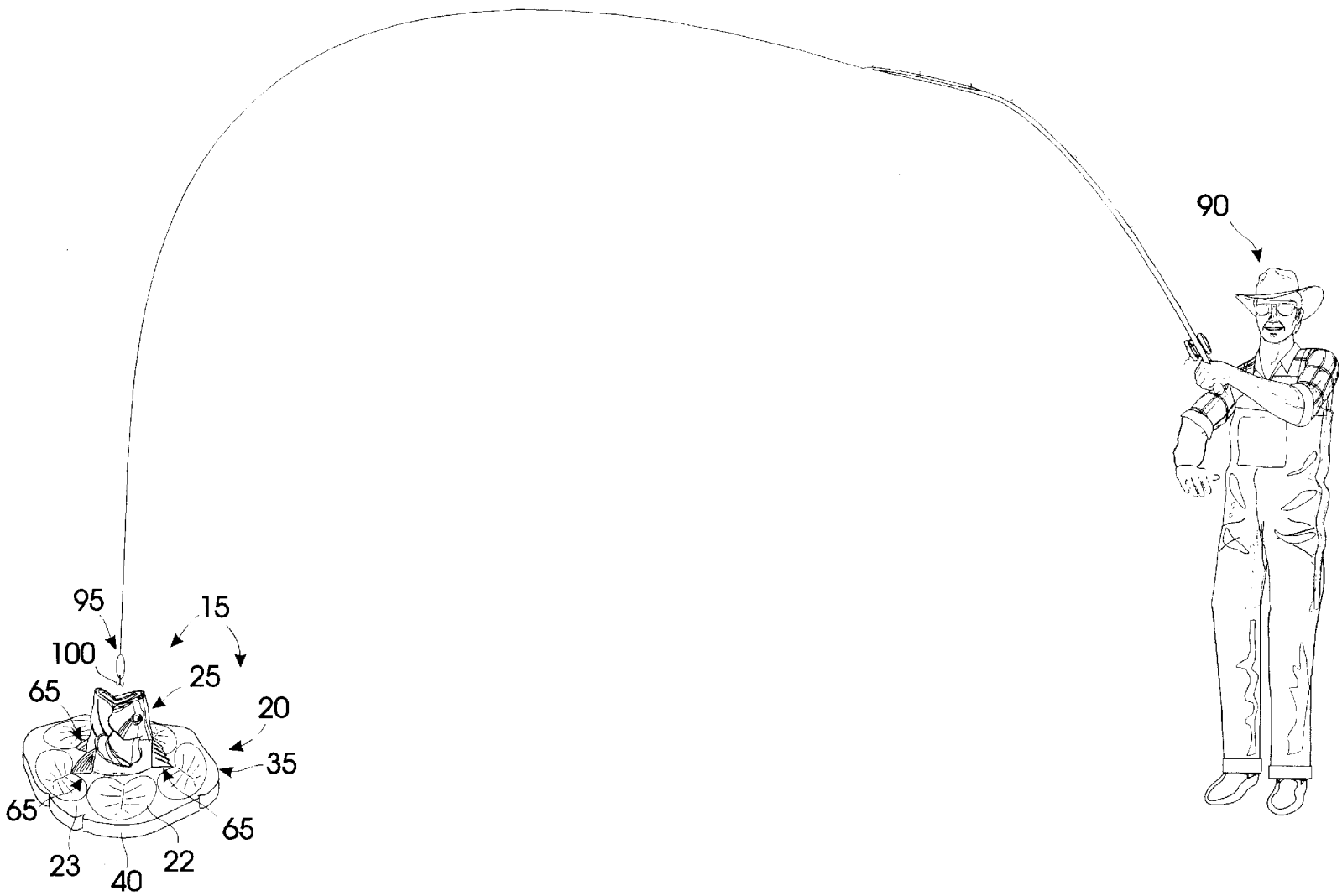
FIG. 1 is an environmental isometric view of a my Spin Cast and Flipping Target Pad in use.
Figure 2:
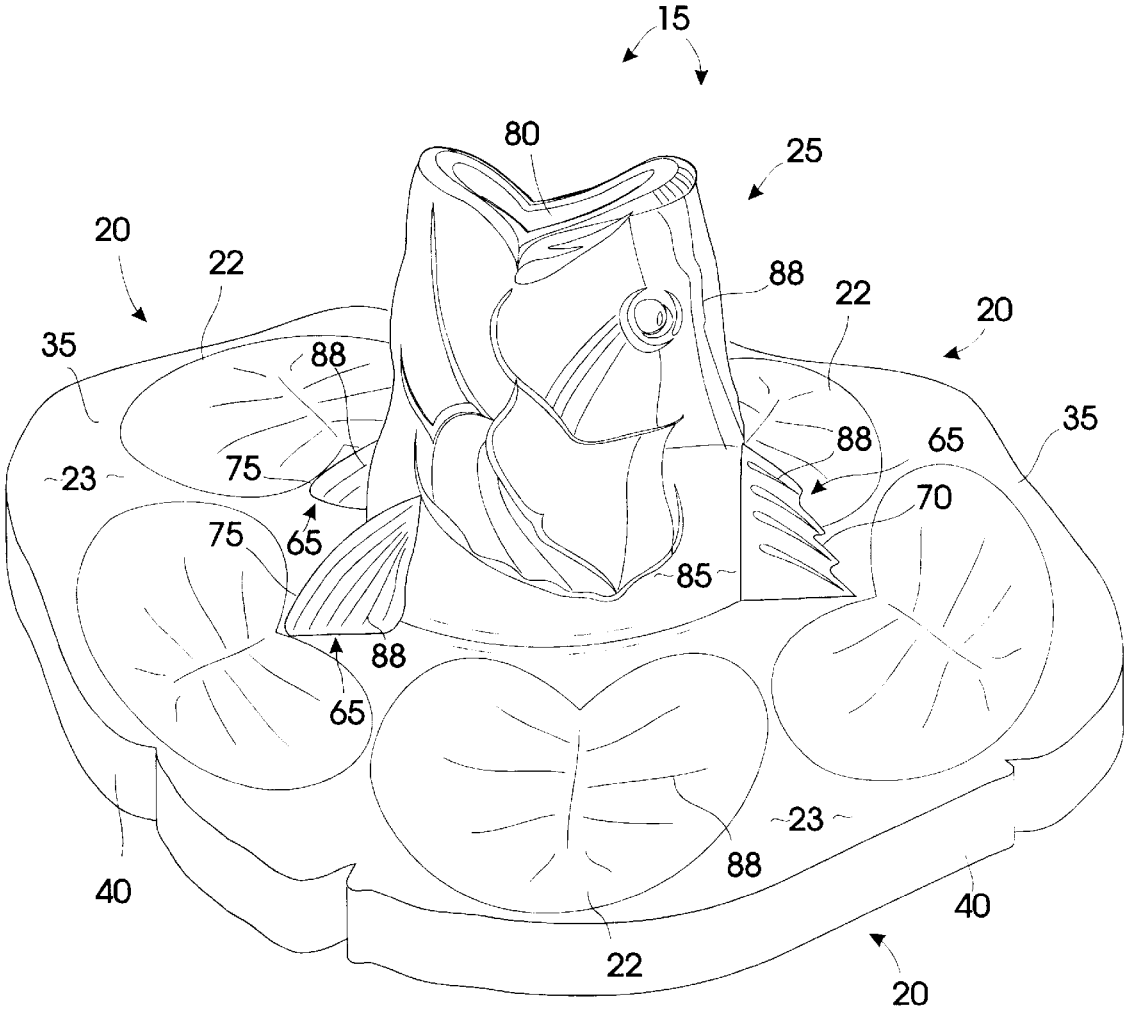
FIG. 2 is an isometric view of my target pad.
Figure 3:
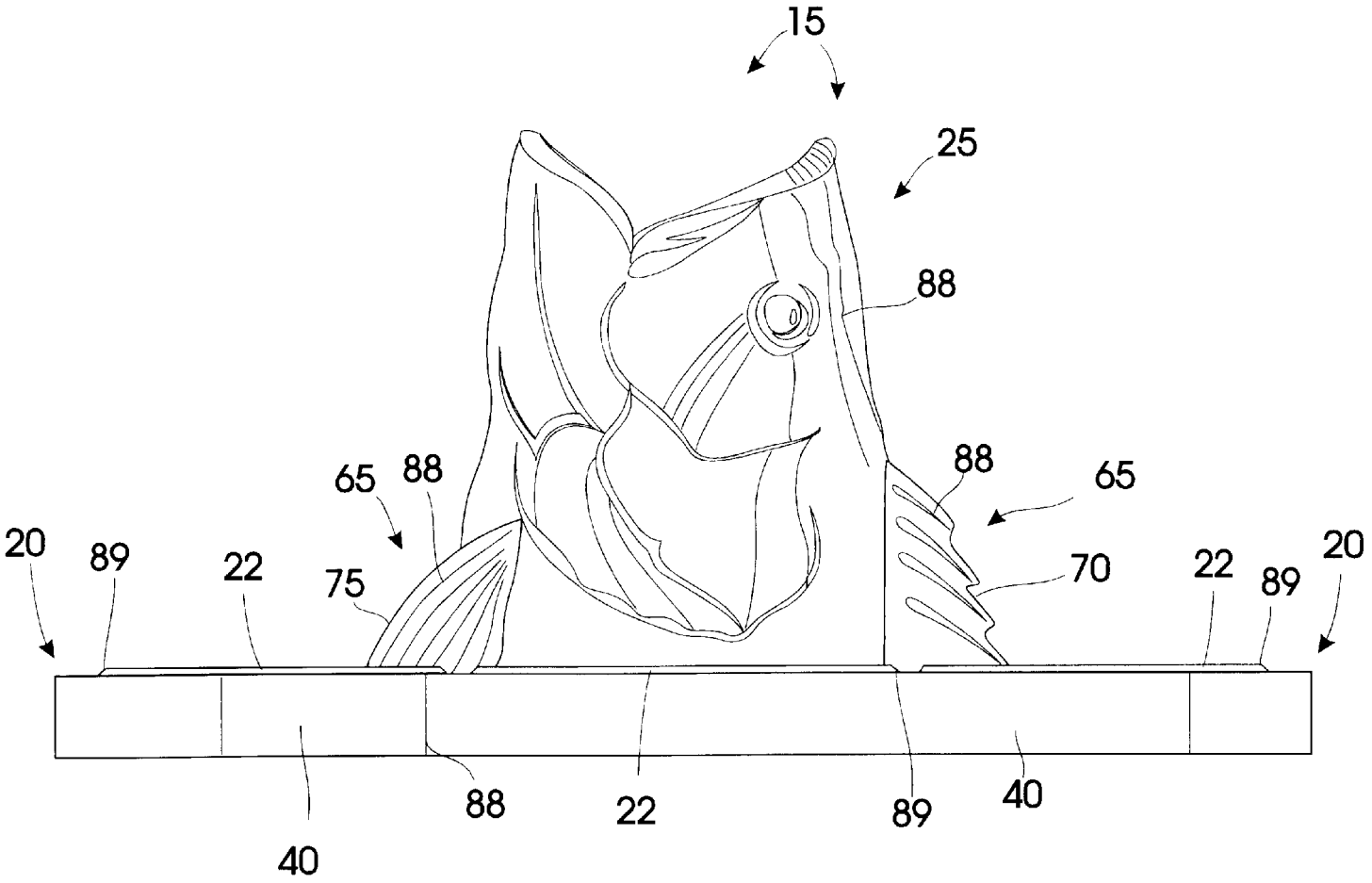
FIG. 3 is a side view of the preferred embodiment of my target pad.
Figure 4:
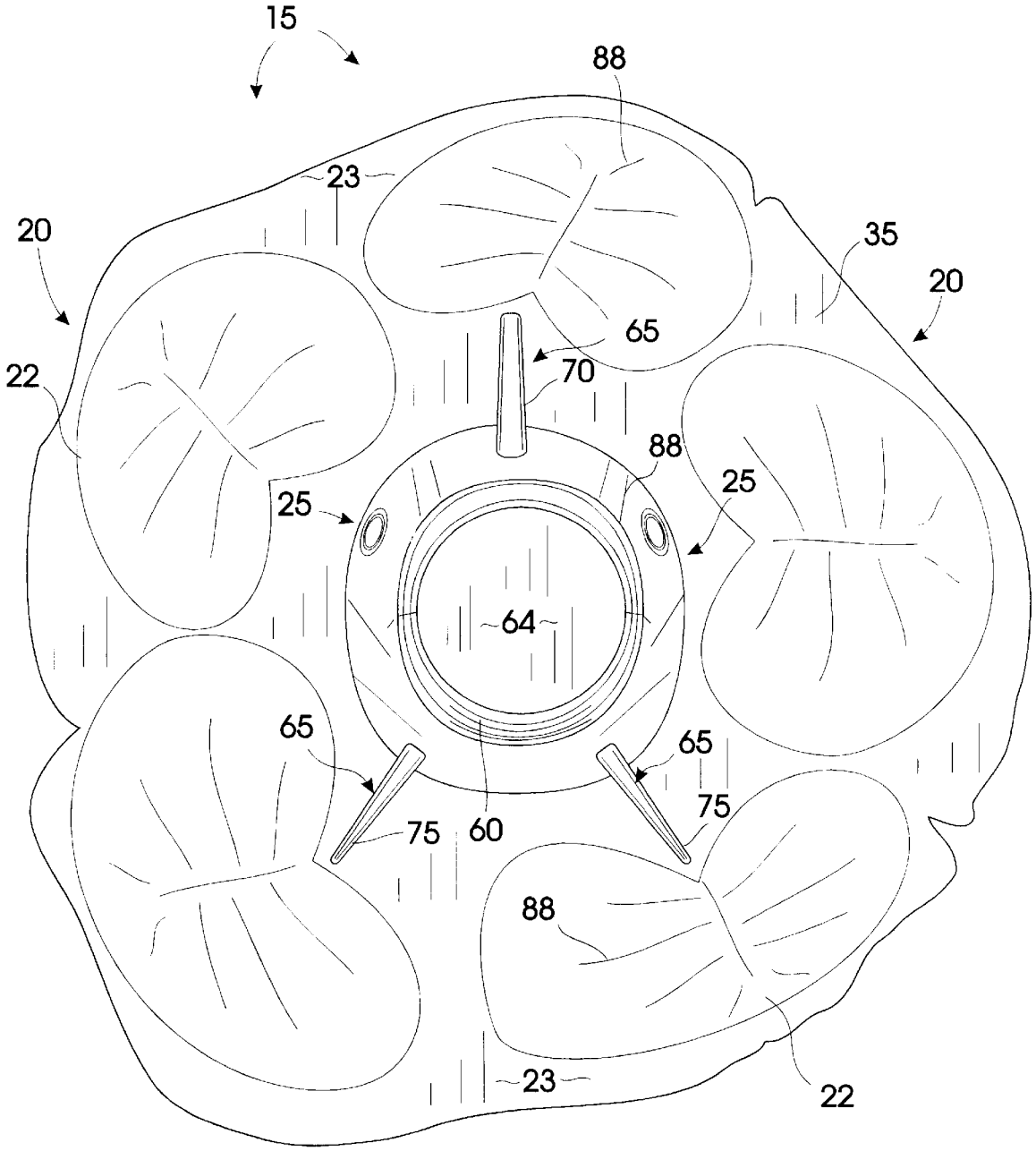
FIG. 4 is a top plan view of the preferred embodiment of my target pad.

With reference now to the accompanying drawings, the preferred embodiments of my spin cast and flipping target pad are broadly designated by the reference numerals 15 and 15A. They primarily comprise a base portion 20 and an open top, generally cylindrical, target portion 25 extending upwardly from the base portion 20. In the preferred embodiments of the target pad 15, the base 20 defines lily pad shapes 22 in its upper surface 23 and the target cylinder 25 is shaped like a fish head, such as the head of a Large Mouth Bass. The first preferred embodiment 15 is formed of an injection molded resilient material or the like as illustrated in FIGS. 1 through 8. A second preferred embodiment 15A illustrated in FIG. 9 has a decorative wooden base 20A making it more appropriate for use in an office setting or the like, whereas the resilient embodiment 15 is well suited for outdoor rugged use.

The base 20 comprises a bottom portion 30, a top portion 35 and an edge portion 40 extending between the bottom portion 30 and the top portion 35. In the first preferred embodiment 15 the base 20 defines a flotation cavity 42. The resilient embodiment 15 is particularly well suited for use as a floating target 15. However, it is within the scope of the present invention that the second preferred embodiment 15A, employing a wooded base 20A would also be buoyant. In the preferred resilient embodiment 15, the upper surface 23 of the top portion 35 defines raised lily pad shapes.

Figure 5:
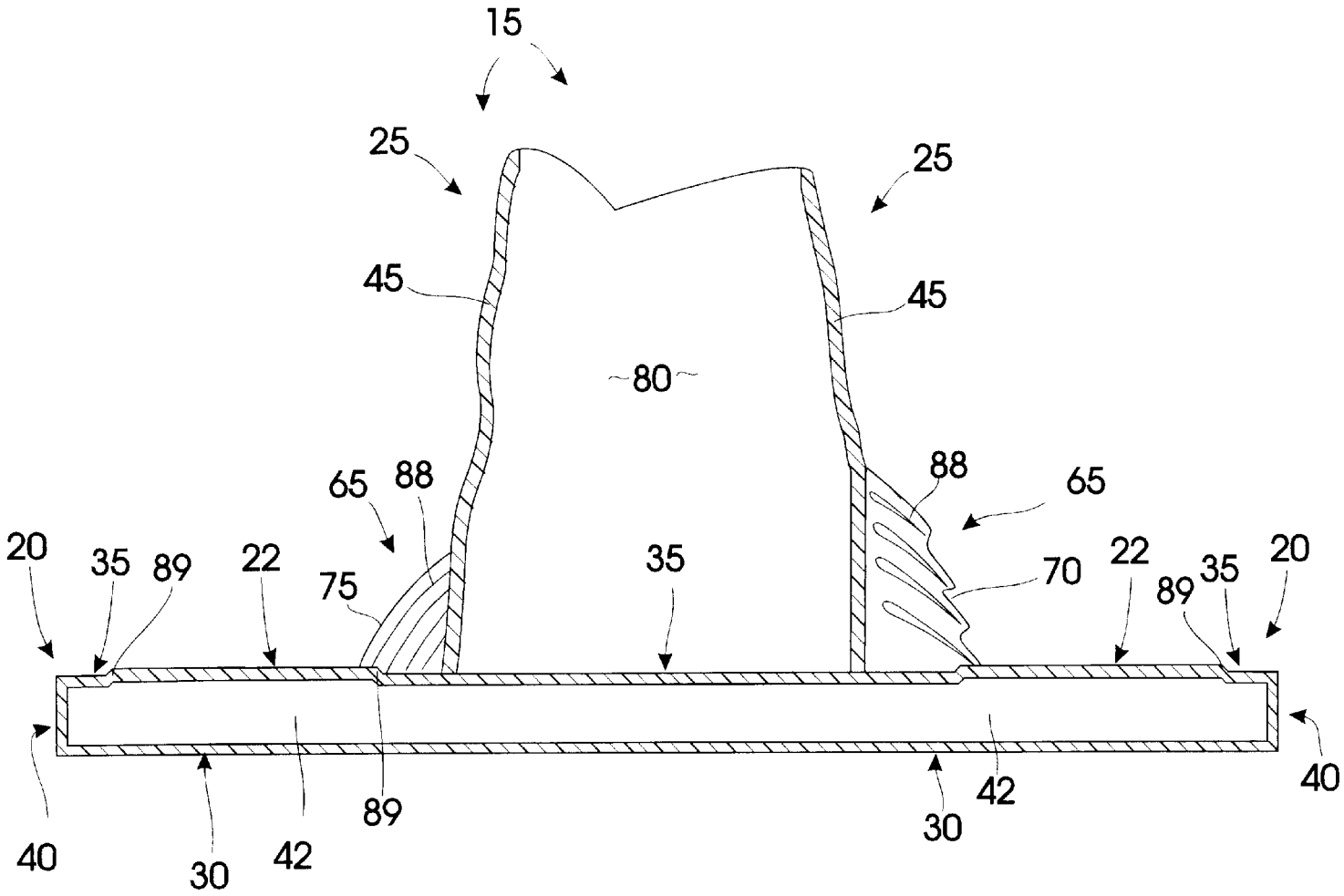
FIG. 5 is a fragmented side view of an injection molded embodiment of my target pad.
Figure 6:
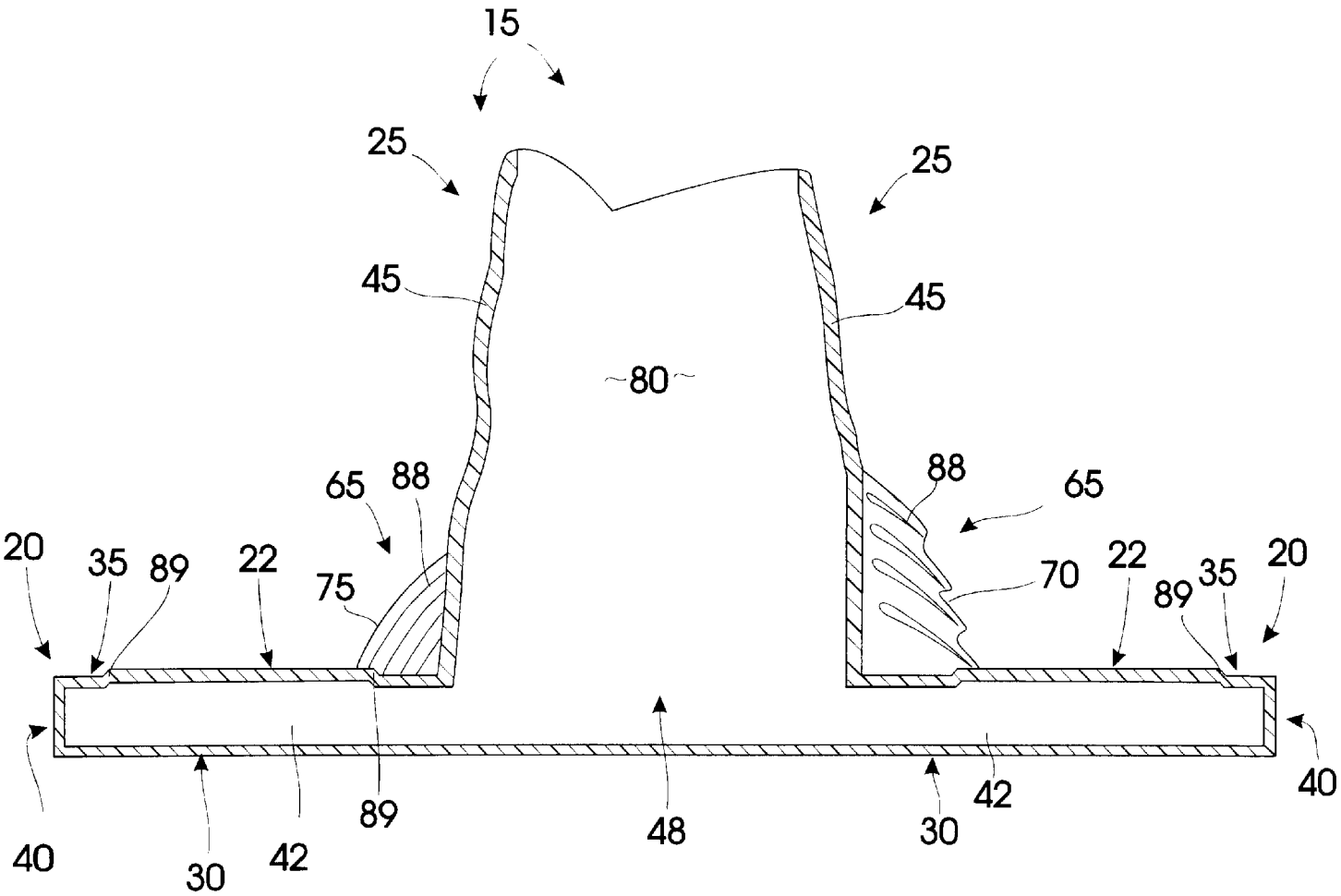
FIG. 6 is a fragmented side view of an alternative configuration of the injection molded embodiment of my target pad with the target cylinder open into the base.
Figure 7:
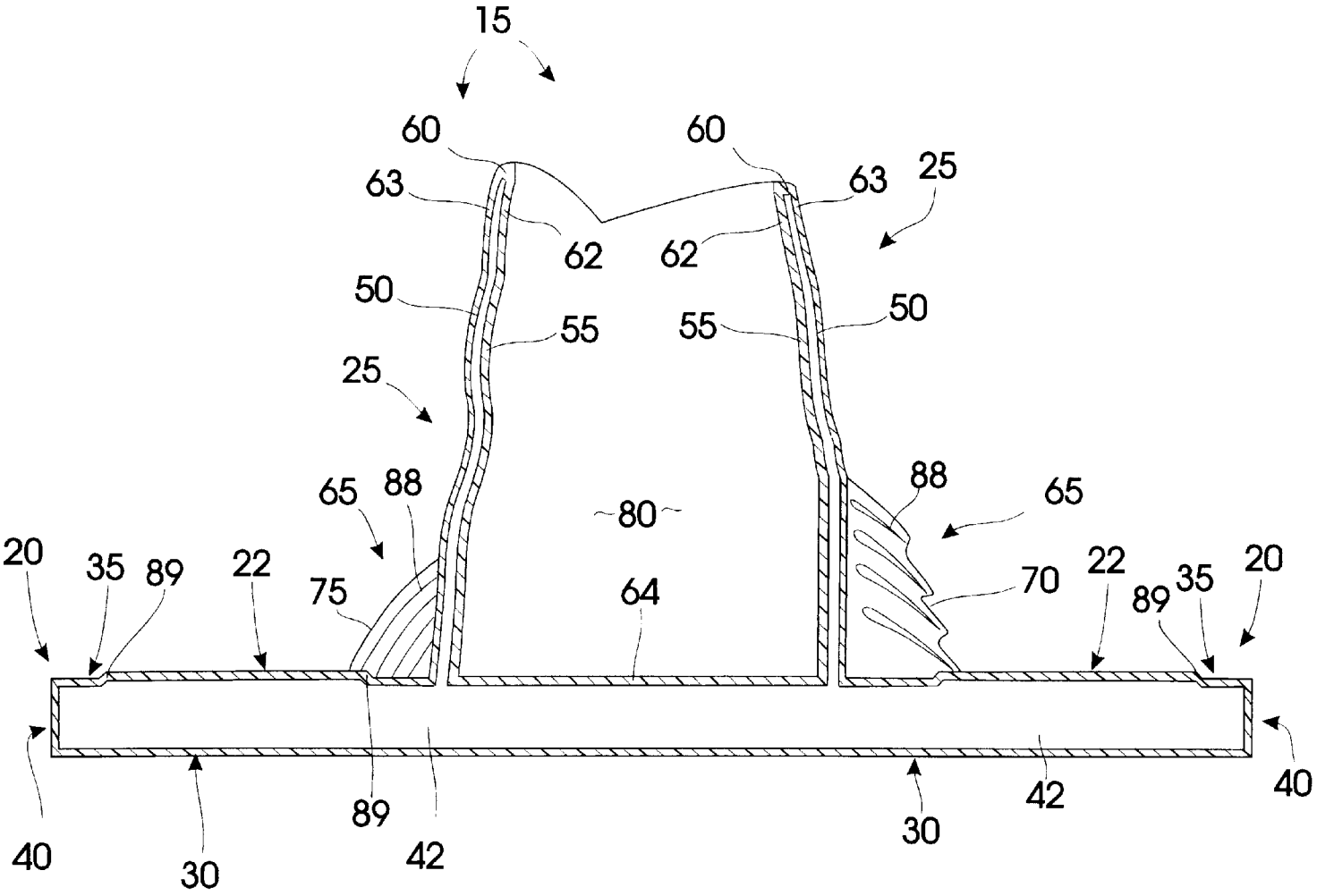
FIG. 7 is a fragmented side view of an alternative configuration of the injection molded embodiment of my target pad with the side walls of the target cylinder generally parallel.
Figure 8:
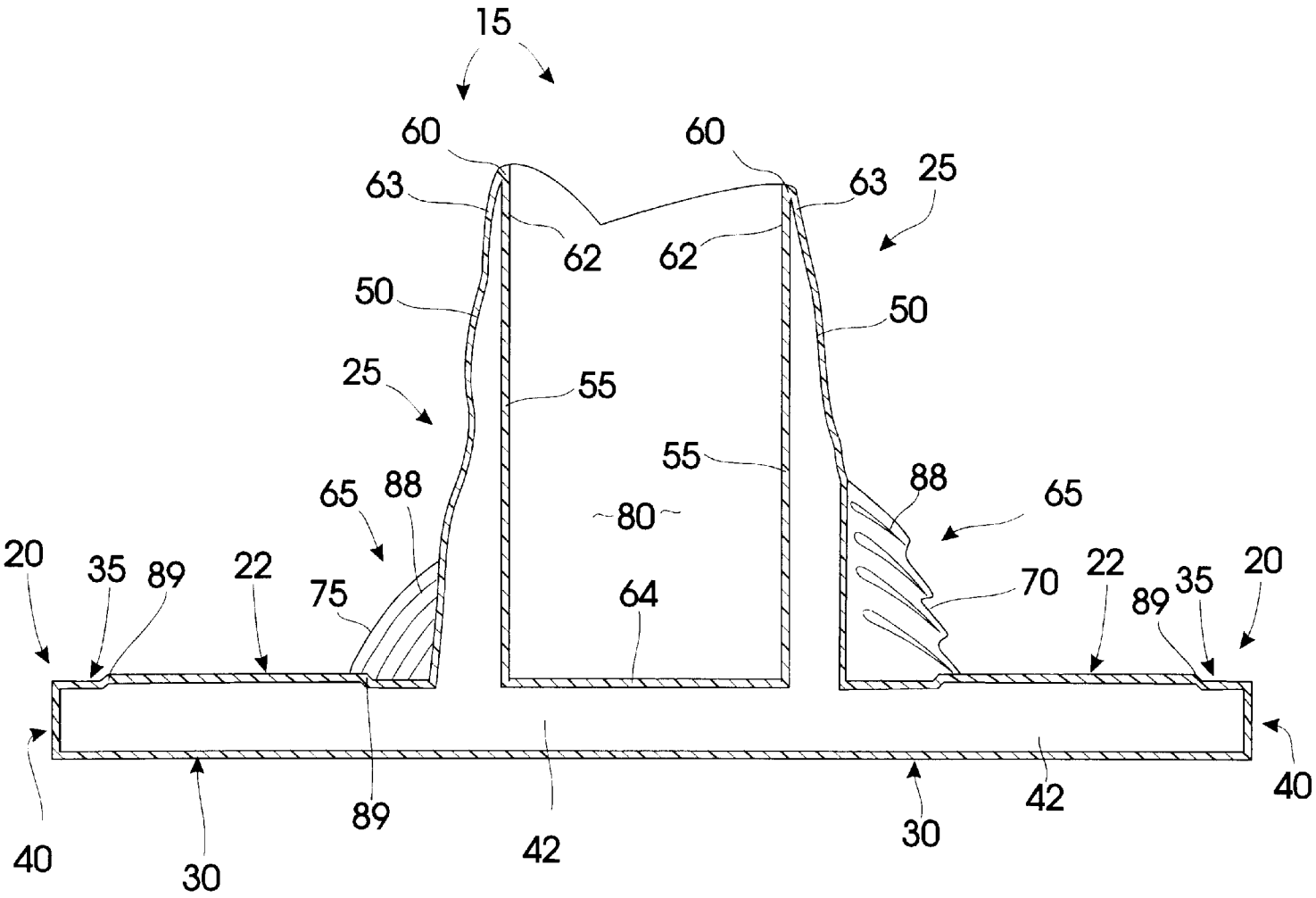
FIG. 8 is a fragmented side view of an alternative configuration of the injection molded embodiment of my target pad with a generally cylindrical inner target cylinder wall.
Figure 9:
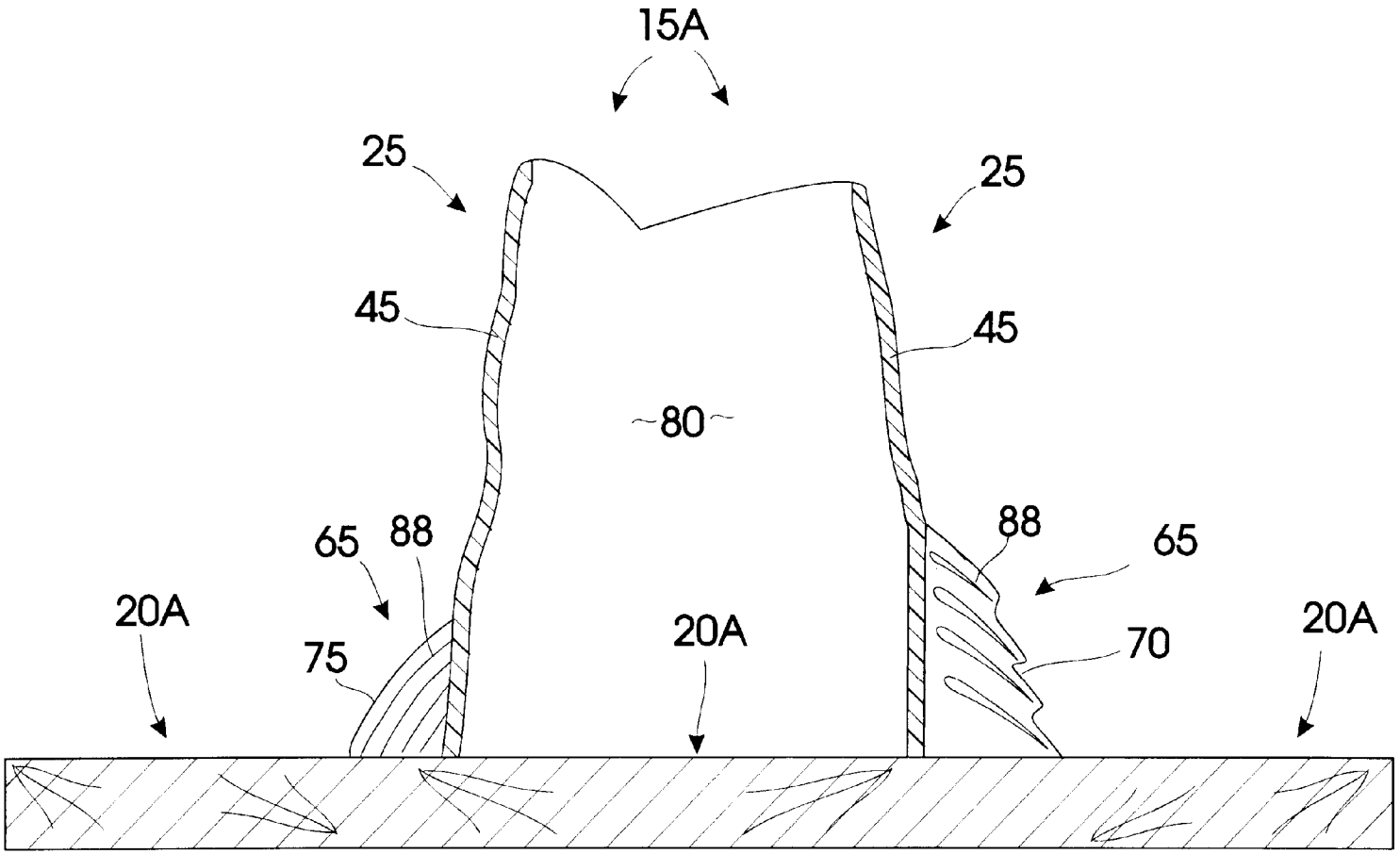
FIG. 9 is a fragmented side view of an alternative embodiment of my target pad employing a wooden base.

The open top, generally cylindrical target portion 25 extends upwardly from the top portion 35 of the base 20. As illustrated in FIGS. 5 and 6, in the preferred embodiment 15, the target portion 25 can be formed of a single layer 45 of resilient material. A single layer target cylinder 25 can extend upwardly from a closed base 20 as illustrated in FIG. 5 or a base 20 defining an opening 48 aligned with the target cylinder 25 as illustrated in FIG. 6. Turning to FIGS. 7 and 8, alternative configurations for the target cylinder 25 are disclosed. In these versions of the preferred embodiment, the target cylinder 25 is comprised of an outer wall 50 and an inner wall 55, each extending upwardly from the top 35 of the base 20. A lip 60 extends between the upper extents 62 and 63 of the inner wall 55 and the outer wall 50, respectively. The inner and outer walls 55 and 50 may be disposed generally parallel with each other as illustrated in FIG. 7, or the inner wall 55 can be generally cylindrical while the outer wall 50 is shaped like a fish head as illustrated in FIG. 8. The inner wall 55 of the latter two embodiments (FIGS. 7 and 8) joins a floor 64 to the target cylinder 25. This floor my be disposed generally at the level of the top 35 of the base 20, below it or well above it. The lily pad shapes 22 defied in the upper surface 23 of the top portion 35 of the base 20 are preferably molded in such a way that the thickness of the upper portion 35 of the base 20 is uniform, as illustrated in FIGS. 5 through 9.

A set of gussets 65, preferably three, extend from the target cylinder 25 to the base portion 20. Preferably, the gussets 65 are shaped and positioned like fish fins in conjunction with the fish head shaped target cylinder 25. A larger gusset 70 is in the position of the fish's dorsal fin 70. A pair of somewhat smaller gussets 75 simulate pectoral fins 75. The gussets 65 act to provide rigidity and additional support to the target cylinder 25.

The interior of the target cylinder 25 preferably has a smooth inner surface 80. The exterior of the entire target pad 15 is relatively smooth only having gentle texturing 88. The slightly raised lily pads 22 defined in the upper surface 23 of the base 20 have relatively smooth edges 89. Smoothness of the texturing 88 and the lily pad edges 89 allows a fisherman 90 to use lures 95 complete with hooks 100 with the target pad 15 for effective practice. This allows a fisherman 90 to practice with actual lures 95 to provide realistic training, as a plug or bob fails to accurately simulate the balance, weight and density associated with various lures.

Figure 10:
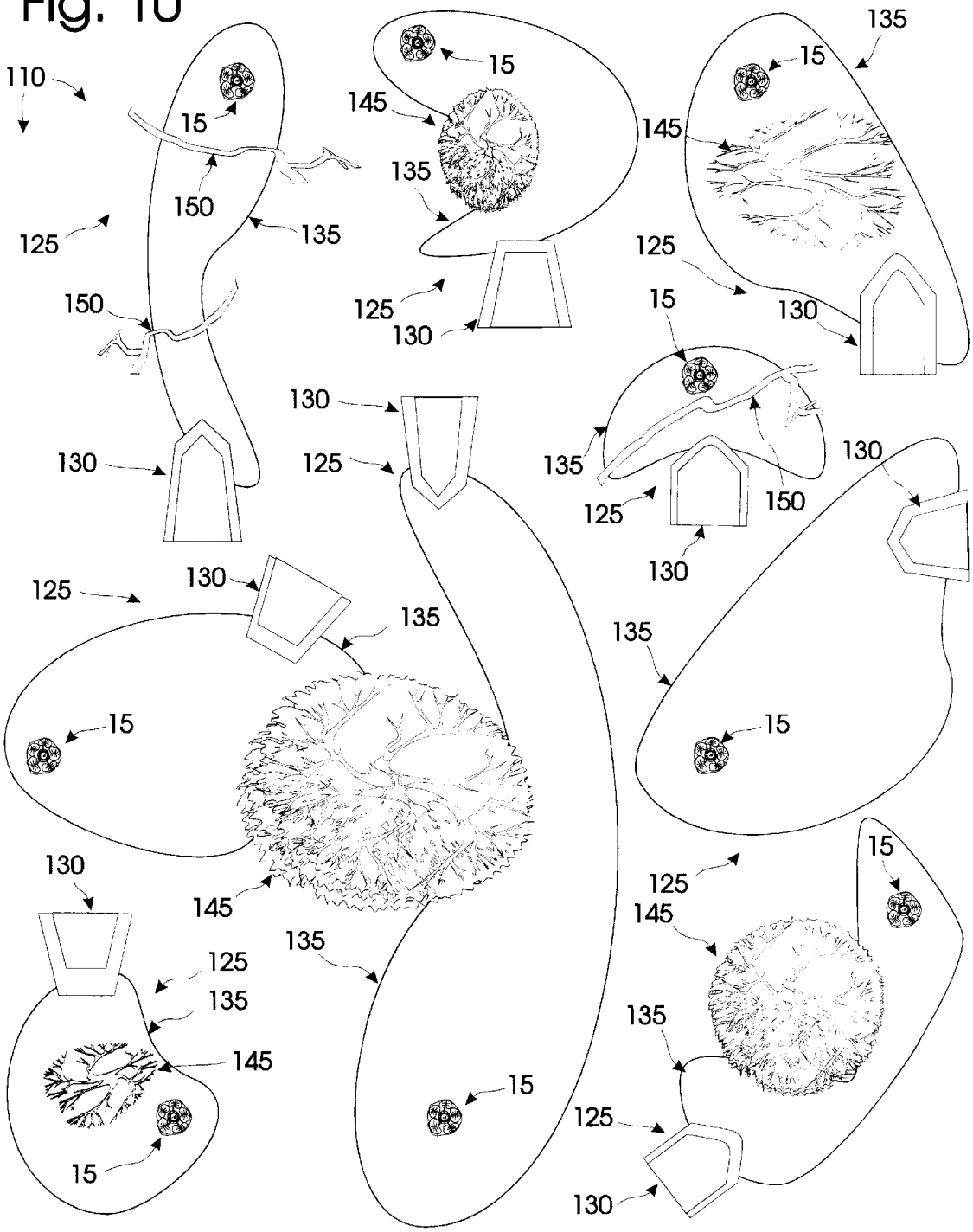
FIG. 10 is a plan view of a portion of a game course employing my target pad.

A game 110 employing, the present invention 15 is generally illustrated in FIG. 10. This game 110 takes the form of a course of casting or flipping practice stations 125. Each station 125 comprises a platform 130 shaped like the bow or stern of a bass fishing boat, a pool 135 and a spin cast and flipping target pad 15 floating in the pool 135. Obstacles, in the form of trees 145 disposed between the platforms 130 and the target pad 15, overhead limbs, logs 150 or the like, are also employed. The player or fisherman stands on the platform 130 and casts or flips a lure 95 toward the target pad 15. Scoring can be based on a total of casts over the course 120 to place the lure 95 in the target cylinder 15 at each station 125, with the lower score winning. Alternatively, groups can compete in a match play format with each station 125 being awarded to the player who lands his lure 95 in the target cylinder 15 in the fewest attempts.

From the foregoing, it will be seen that this invention is one well adapted to obtain all the ends and objects herein set forth, together with other advantages which are inherent to the structure.

It will be understood that certain features and subcombinations are of utility and may be employed without reference to other features and subcombinations. This is contemplated by and is within the scope of the claims.

As many possible embodiments may be made of the invention without departing from the scope thereof it is to be understood that all matter herein set forth or shown in the accompanying drawings is to be interpreted as illustrative and not in a limiting sense. For example the use of flotation material in the base 20 or construction of the target pad 15 from a composite material such as fiberglass is anticipated by the present disclosure. Additionally, the incorporation of an obstacle extending upwardly from the base 20, adjacent the target cylinder 25 is also anticipated by the present disclosure.

What is claimed is:

1. An integral spin cast and flipping target pad comprising:

a resilient base portion comprising a bottom portion, a top portion and an edge portion extending between said bottom portion and said top portion, said base portion defining and internal flotation cavity;

an open top generally cylindrical, resilient target portion, shaped like a fish head, extending upwardly from said top portion, said target portion comprising a generally cylindrical wall portion extending upwardly from said top portion of said base portion, said wall portion comprising:

a cylindrical inner wall extending upwardly from said top portion of said base;

an outer wall portion extending upward from said top portion of said base, spaced apart from said inner wall portion; and, a lip portion extending between a top of said inner wall and a top of said outer wall, lily pad shapes defined in an upper surface of said top portion;

gussets extending from said target portion to said base portion; and an opening defined in said top portion of said base portion, aligned with a bottom portion of said target portion.

2. An integral spin cast and flipping target pad as defined in claim 1 wherein said target portion has smooth inner surfaces.

3. An integral spin cast and flipping target pad comprising:

a resilient base portion comprising a bottom portion, a top portion and an edge portion extending between said bottom portion and said top portion defining a flotation cavity within said base, said top portion defining an opening; and, a resilient, open top, generally cylindrical target portion, shaped like a Large Mouth Bass head, extending upwardly from said top portion said target portion comprising a generally cylindrical inner wall extending upwardly from said top portion of said base portion, a generally cylindrical outer wall portion extending upwardly from said top portion of said base portion and a lip portion extending between a top of said inner wall portion and a top of said outer wall portion, and a bottom portion aligned with said opening in said top portion of said base;

fish fin shaped gussets extending from a base of said outer wall portion to said top portion of said base portion; and, lily pad shapes defined in an upper surface of said top portion.

4. An integral spin cast and flipping target pad as defined in claim 3 wherein inner surfaces of said inner wall are smooth.

5. A spin cast and flipping target game course comprising:

a plurality of casting or flipping practice stations, each of said stations comprising:

a pool of water;

a platform disposed at an edge of said pool;

a spin cast and flipping target pad floating in said pool, said target pad comprising:

a base portion comprising a bottom portion, a top portion and an edge portion extending between said bottom portion and said top portion defining a flotation cavity within said base;

a fish head shaped open top generally cylindrical target portion extending upwardly from said top portion, said target portion comprising a generally cylindrical inner wall extending upwardly from said top portion of said base portion, a generally cylindrical outer wall portion extending upwardly from said top portion of said base portion and a lip portion extending between a top of said inner wall and a top of said outer wall; and, gussets extending from said target portion to said base portion; and, obstacles comprising trees, limbs, logs and stumps disposed about said course, extending between said platforms and said target pads.

6. A spin cast and flipping target game course as defined in claim 5 wherein said platforms are shaped like a portion of a fishing boat.

* * * * *